US005367961A

United States Patent [19]

Arai et al.

[11] Patent Number: 5,367,961

[45] Date of Patent: Nov. 29, 1994

[54] PALLET SUPPORT LEG INCLUDING SEMI-CIRCULAR FLANGE BLADES

[76] Inventors: Hiroshi Arai; Clifford B. Hewson; John W. Hartloff, all of 4740 Princeton Avenue, Richmond, British Columbia, Canada, V7E 4P2

[21] Appl. No.: 968,085

[22] Filed: Oct. 28, 1992

[51] Int. Cl.[5] ..... B65D 19/32

[52] U.S. Cl. ..... 108/56.3; 108/901

[58] Field of Search ..... 108/51.1, 56.1, 56.3; 248/188, 188.1; 206/326, 599, 600

[56] References Cited

U.S. PATENT DOCUMENTS

| | | | |
|---|---|---|---|
| 3,401,908 | 9/1968 | Rapata | 248/188.8 |
| 3,438,342 | 4/1969 | Woolworth et al. | 108/51 |
| 3,590,751 | 7/1971 | Freid | 108/51 |
| 3,610,172 | 10/1971 | Wharton | 108/51 |
| 3,664,272 | 5/1972 | Sanders | 108/53 |
| 3,685,463 | 8/1972 | Francis | 108/56.1 |
| 3,804,032 | 4/1974 | Baucom | 108/51.1 |
| 3,915,099 | 10/1975 | Wies et al. | 108/56.1 |
| 4,267,781 | 5/1981 | Powers | 108/56.1 |
| 4,425,852 | 1/1984 | Riviere | 108/56.3 |
| 4,799,433 | 1/1989 | Luft | 108/51.1 |
| 5,117,762 | 6/1992 | Shuert | 108/51.1 |
| 5,197,396 | 3/1993 | Breezer et al. | 108/56.1 X |

FOREIGN PATENT DOCUMENTS

| | | | |
|---|---|---|---|
| 0153917 | 9/1985 | European Pat. Off. . | |
| 0487180 | 5/1992 | European Pat. Off. | 108/51.1 |
| 2128033 | 10/1972 | France . | |
| 1330180 | 9/1972 | United Kingdom | 108/51.1 |
| 1362075 | 7/1974 | United Kingdom . | |

OTHER PUBLICATIONS

"Ecology Pallet" (undated Japanese brochure).

*Primary Examiner*—Clifford D. Crowder
*Assistant Examiner*—Ismael Izaguirre
*Attorney, Agent, or Firm*—Oyen Wiggs Green & Mutala

[57] ABSTRACT

A pallet support leg having a first short, hollow columnar member with a lower base portion which is indented to form a second hollow columnar member. The second member protrudes upwardly within the first member by no more than about one-third the height of the first member. A circular flange protrudes outwardly from and encircles an upper portion of the first member to support the underside of a sheet of pallet material. At least one semi-circular flange or blade protrudes outwardly from the first member, above the circular flange, and extends around a radial segment of the first member to engage the upper surface of the pallet material, sandwiching the pallet material between the two flanges or between the blades and the circular flange. A first set of support ribs are fixed between the underside of the circular flange and the first member. The ribs are disposed radially around the first member to add structural rigidity to the circular flange.

12 Claims, 9 Drawing Sheets

PALLET SUPPORT LEG INCLUDING SEMI-CIRCULAR FLANGE BLADES

FIELD OF THE INVENTION

This application pertains to a pallet leg which can be removably attached to a sheet of pallet material to form a shipping pallet. After the pallet has been used, the leg(s) can be removed for compact transportation of the legs (with or without the sheet material) to another point, at which the legs may again be used to form a pallet.

BACKGROUND OF THE INVENTION

Shipping pallets are conventionally made of scrap lumber, fibreboard, etc. by nailing or otherwise fastening pieces of such material together. After a pallet has served its shipping purpose it is normally discarded, unless it can be reused to transport a new shipment from the point at which the original shipment was received. Empty pallets are not normally transported for use elsewhere because the cost of transporting relatively bulky pallets often exceeds their value. It is impractical to disassemble a pallet and transport the relatively compact pallet pieces for reassembly of the pallet elsewhere, because disassembly often damages or destroys the pieces and because the cost of disassembling and reassembling conventional pallets is high compared to their value.

The prior art has accordingly evolved a variety of reusable pallet structures. These typically take the form of a series of stubby legs which are used to interconnect sheets of pallet material at several points to form a pallet. The legs are normally made of plastic or similar tough, impact resistant material. The pallet is formed by releasably attaching the legs to the pallet sheets at predrilled apertures provided in the sheets. After the pallet has served its purpose (i.e. after the pallet has been used to ship goods from a source to a destination) the legs can be removed in order to disassemble the pallet. The legs, which are typically formed so that they can be compactly nested together, may then be transported to another shipping point where they can be reused to construct additional pallets. The sheet material may or may not be returned with the pallet legs. In either case, pallets can be quickly, repeatedly assembled and disassembled without damaging the legs or the pallet sheet material. The disassembled legs and/or sheets can be transported more economically than empty pallets since the disassembled materials occupy much less storage space than pallets.

The present invention provides an improved pallet leg.

SUMMARY OF THE INVENTION

In accordance with the preferred embodiment, the invention provides a pallet support leg comprising a first short, hollow columnar member having a lower base portion which is indented to form a second hollow columnar member. The second member protrudes upwardly within the first member by no more than about one-third the height of the first member. A circular flange protrudes outwardly from and encircles an upper portion of the first member to support the underside of a sheet of pallet material. At least one semi-circular flange protrudes outwardly from the first member, above the circular flange, and extends around a radial segment of the first member to engage the upper surface of the pallet material, sandwiching the pallet material between the two flanges. A first set of support ribs are fixed between the underside of the circular flange and the first member. The ribs are disposed radially around the first member to add structural rigidity to the circular flange.

The semi-circular flanges are preferably blades displaced above the circular flange by an amount less than the thickness of a sheet of pallet material. Instead of engaging the upper surface of the pallet material as aforesaid, the blades cut into the material below its top surface. This sandwiches the pallet material between the blades and the circular flange, but without leaving any portion of the pallet leg protruding upwardly above the pallet material.

A second set of support ribs are fixed between the inside of the first columnar member and the outside of the second columnar member. The second set of ribs are disposed radially around the columnar members.

Advantageously, the second columnar member is shaped to receive a tool for rotating the support leg relative to a sheet of pallet material. At least one anti-skid ring may optionally be provided on the lower base portion of the first columnar member.

The second columnar member has an apertured upper end. A foot member is provided for releasable engagement within the apertured upper end of the second columnar member. The second columnar member makes lateral contact over an extended side portion of the foot member when the foot member is releasably engaged within the second columnar member. Preferably, the second columnar member is hexagonally shaped and the contacted side portion of the foot member is circular.

The foot member comprises a third hollow columnar member. A circular flange protrudes outwardly from and encircles a lower portion of the third columnar member. A releasable engaging means is provided on an upper portion of the third columnar member for releasably engaging the third columnar member with the second columnar member. The circular flange may be radially extended to cover about the same cross-sectional area as the lower base portion of the first columnar member. In this case, the foot member has an outwardly sloped outer circumferential edge, and a plurality of concave ribs fixed at radial intervals between opposed internal sides of the edge. This allows the foot member to cushion the load supported by the pallet leg.

The releasable engaging means may take the form of one or more snap rings which encircle the upper portion of the third columnar member. The outer diameter of the snap ring(s) is slightly greater than the diameter of the aperture; and, the outer diameter of the third columnar member is slightly less than the diameter of the aperture.

A plurality of slots may be provided in the third columnar member, with the slots extending transversely to the snap ring(s).

DETAILED DESCRIPTION OF THE PREFERRED EMBODIMENT

Figure 1:
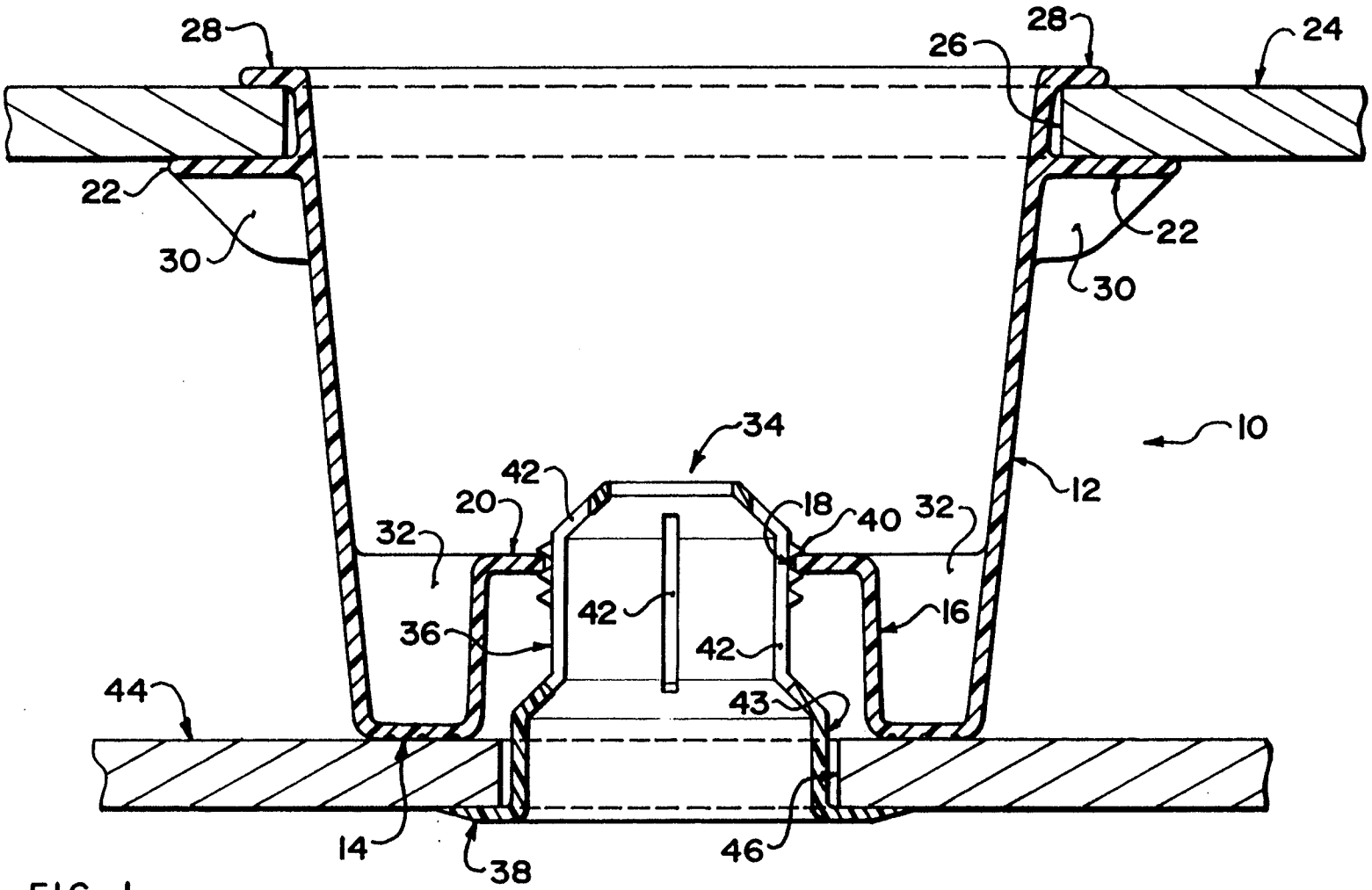
FIG. 1 is a cross-sectional side elevation view of a pallet having a pallet leg which grips a sheet of pallet material between two outwardly protruding flanges.

FIG. 1 depicts a pallet support leg 10 made of plastic or similar tough, resilient, impact resistant material. Leg 10 has a first short, hollow columnar member 12 with a base portion 14 which is indented to form a second hollow columnar member 16. Second member 16 protrudes upwardly within first member 12 by no more than about one-third the height of first member 12. A circular aperture 18 is provided in the upper end 20 of second member 16.

A circular flange 22 protrudes laterally outwardly from a point below the upper end of first member 12. Flange 22 encircles first member 12, forming a flat ledge capable of supporting the underside of a sheet of pallet material 24.

Figure 2:
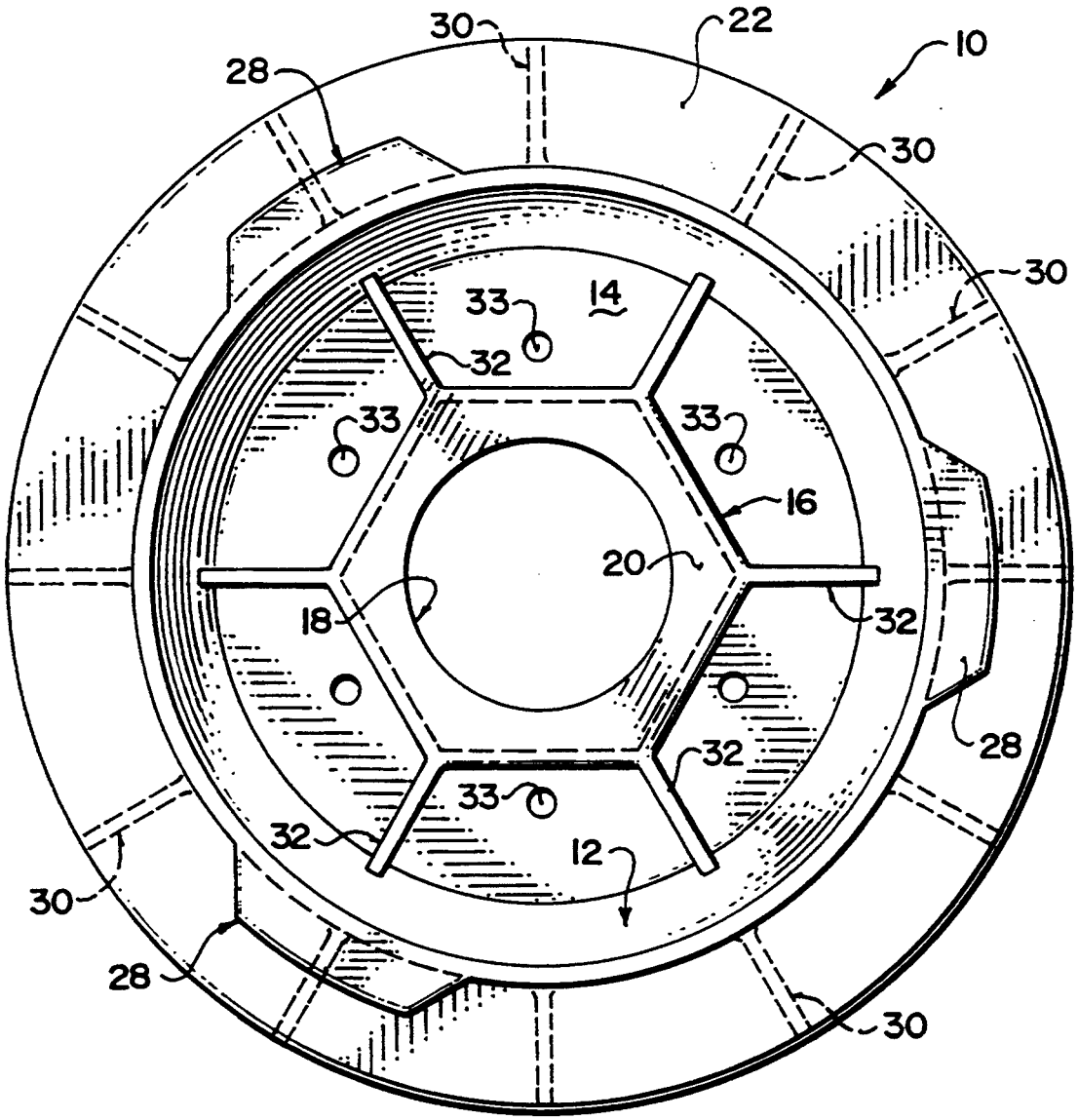
FIG. 2 is a top plan view of the pallet leg of FIG. 1, with the foot member removed.
Figure 5:
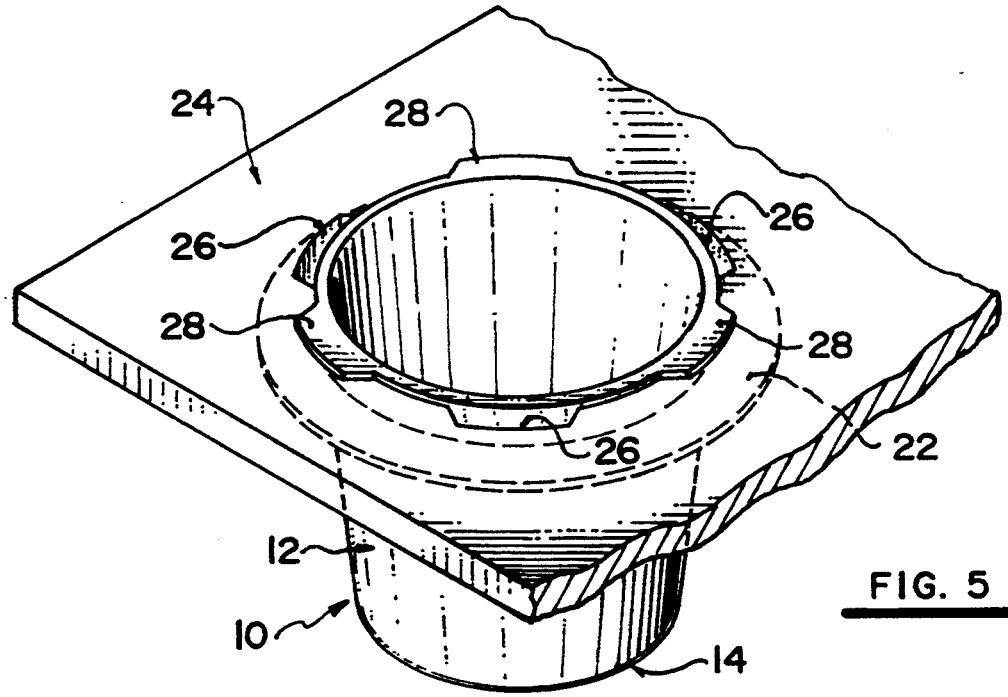
FIG. 5 is a pictorial illustration showing a portion of a pallet having a pallet leg as illustrated in FIG. 1.
Figure 6:
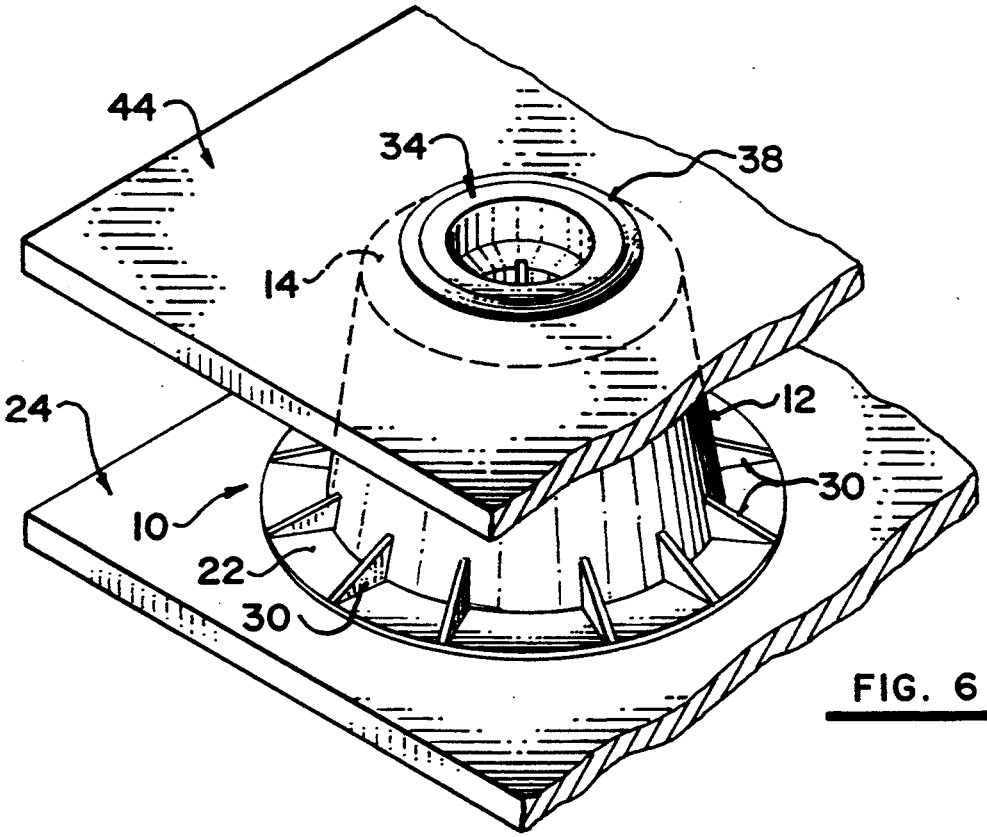
FIG. 6 is a pictorial illustration showing a portion of a pallet in the inverted position, with a second sheet of pallet material being added to the pallet with the aid of the foot member shown in FIG. 3.

As best seen in FIG. 5, a series of apertures 26 are provided in pallet sheet 24 at points where legs 10 are to be releasably attached to sheet 24. To facilitate such attachment, at least one and preferably three semi-circular flanges 28 are provided on first member 12, above flange 22. Flanges 28 protrude laterally outwardly from first member 12 and extend around respective radial segments of first member 12, as best seen in FIG. 2. Apertures 26 are shaped so that flanges 28 may pass therethrough only when a leg 10 is properly oriented relative to an aperture 26. After flanges 28 have passed through sheet 24, leg 10 is rotated relative to sheet 24 to releasably attach leg 10 to sheet 24. More particularly, such rotation displaces flanges 28 radially away from the aperture portions through which they are inserted, so that flanges 28 lie atop pallet sheet 24, thereby sandwiching sheet 24 between flanges 22, 28. Leg 10 can be removed from sheet 24 to disassemble the pallet by rotating leg 10 in the reverse direction to reorient flanges 28 relative to aperture 26 for withdrawal of flanges 28 through the aperture.

In order to strengthen leg 10 and provide adequate support for pallet sheet 24 a plurality of support ribs 30 are fixed between the underside of flange 22 and the outer wall of first member 12. As best seen in FIG. 2, ribs 30 are disposed radially around first member 12.

Base portion 14 is also strengthened by fixing a second plurality of support ribs 32 between the lower inside surface of first member 12 and the adjacent lower outside surface of second member 16. As best seen in FIG. 2, ribs 32 are disposed radially around columnar members 12, 16. If desired, a series of apertures 33 may be provided in base portion 14 for drainage of liquid that would otherwise be trapped within leg 10.

In some applications it will be desirable to employ a series of pallet legs 10 with a single sheet of pallet material 24. In such situations the underside of base portion 14 is allowed to rest on a surface such as a floor. Pallet legs 10 accordingly support pallet sheet 24 away from the floor, providing access for the forks of a lift truck beneath the pallet. However, in other situations, it may be desirable to construct a pallet having upper and lower pallet sheets 24, 44 as depicted in FIG. 1. For this purpose a separate foot member 34 is provided for releasable engagement within aperture 18 of second member 16, as will now be described.

Figure 3:
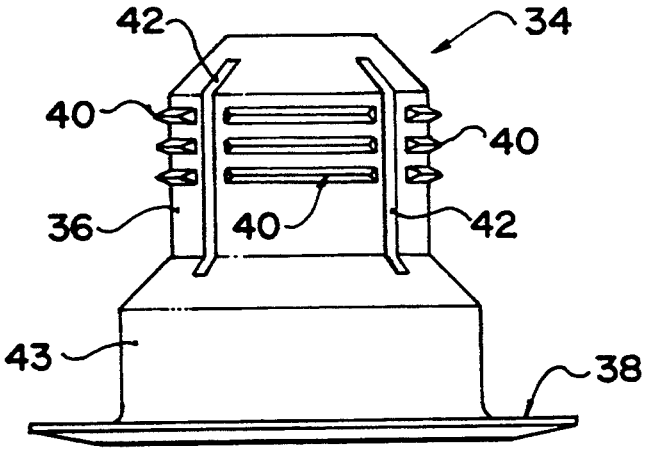
FIG. 3 is a side elevation view of the foot member portion of the pallet leg of FIG. 1.
Figure 4:
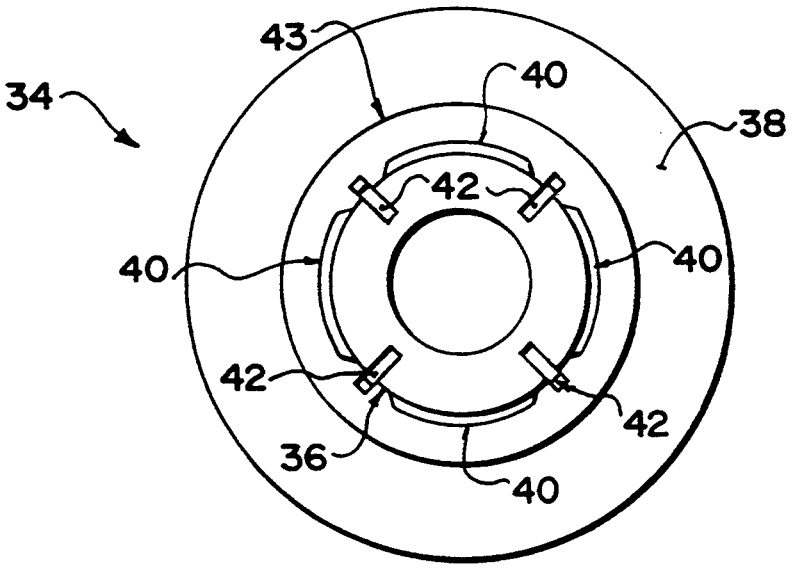
FIG. 4 is a top plan view of the foot member depicted in FIG. 3.

Foot member 34, which is also made of plastic or similar tough, resilient, impact resistant material, includes a third hollow columnar member 36. The upper end of third member 36 is tapered inwardly to guide foot member 34 into aperture 18 as hereinafter explained. A circular flange 38 protrudes laterally outwardly from and encircles the lower end of third member 36. A "releasable engaging means" is provided for releasably engaging foot member 34 within aperture 18. Preferably, the releasable engaging means takes the form of a snap ring 40 provided around the upper end of third member 36. The outer diameter of snap ring 40 is slightly larger than the internal diameter of aperture 18; and, the outer diameter of third member 36 is slightly less than the inner diameter of aperture 18. A plurality of slots 42 extend through the upper portion of third member 36, transversely to snap ring 40. Slots 42 allow third member 36 to flex inwardly as foot member 34 is passed upwardly through aperture 18. This in turn enables snap ring 40 to advance through aperture 18, at which point the resilient nature of third member 36 causes it to flex outwardly so that snap ring 40 rests atop upper end 20 of second member 16, thereby holding foot member 34 in place relative to second member 16. If desired, further snap rings may be provided on third member 36, as depicted in FIG. 3, to facilitate adjustment of the displacement between flange 38 and the underside of base portion 14.

A second sheet of pallet material 44 is provided with apertures sized to receive foot member 34. More particularly, after a series of legs 10 have been releasably attached to first pallet sheet 24 as described above, sheet 24 is inverted and second sheet 44 is laid atop the undersides of base portions 14 of pallet legs 10 to align apertures 46 in sheet 44 above apertures 18 in each of legs 10 affixed to sheet 24. A foot member 34 is then passed downwardly through each aperture 46 in sheet 44 for releasable engagement within the corresponding aperture 18 as aforesaid. Flange 38 is accordingly butted against the underside of sheet 44, thereby sandwiching sheet 44 between flange 38 and the underside of base portion 14. This yields a completed pallet structure having upper and lower sheets 24, 44 spaced apart by legs 10. The pallet is easily disassembled by withdrawing foot members 34 through sheet 44 and then rotating first member 12 to orient flanges 28 relative to aperture 26 for withdrawal of flanges 28 through aperture 26.

Figure 7:
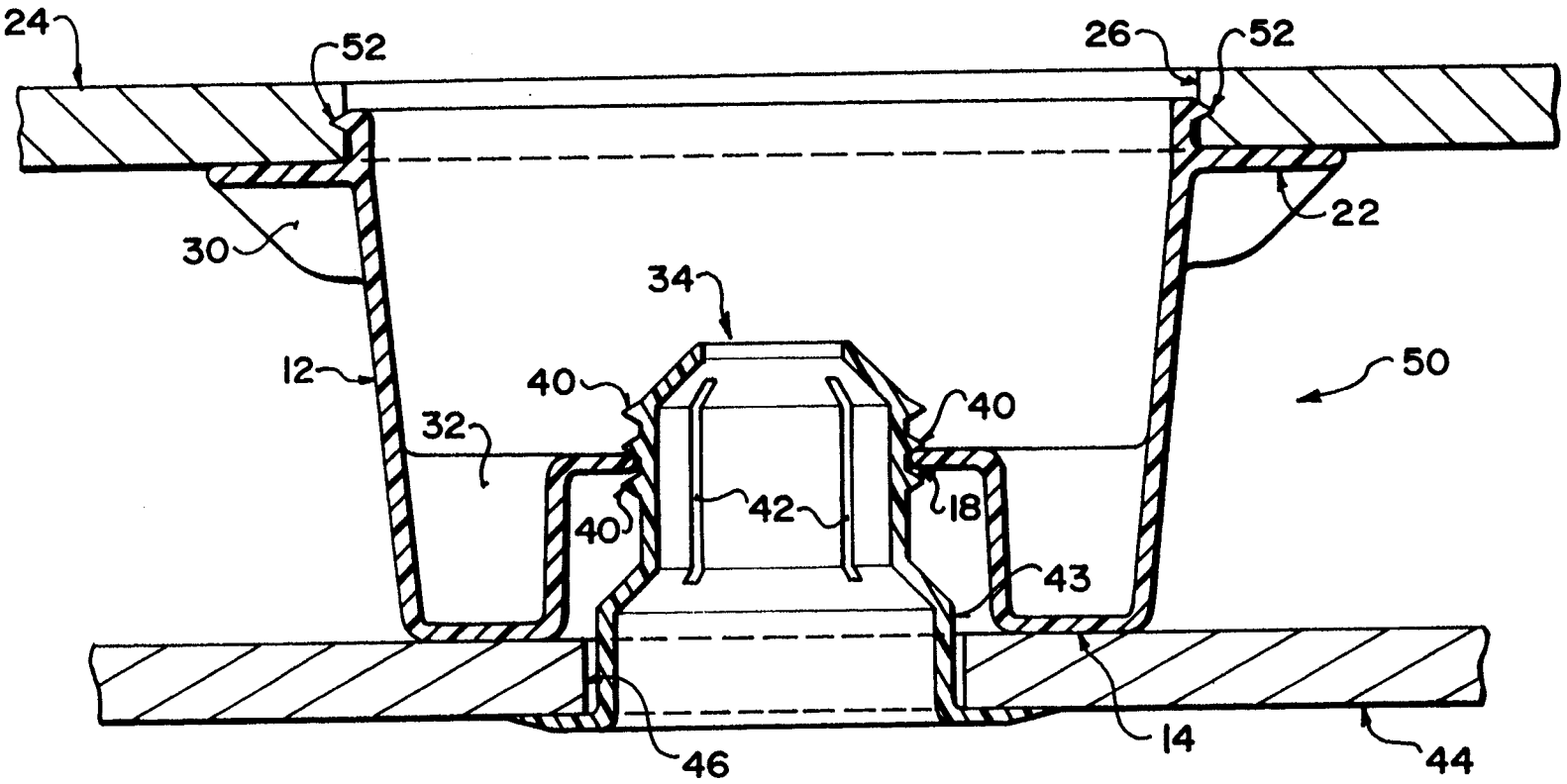
FIG. 7 is a cross-sectional side elevation view of a pallet having a pallet leg which grips a sheet of pallet material with a series of outwardly protruding blades.

It is expected that it will be particularly advantageous to fabricate pallets using oriented strand board (OSB) as pallet sheet material. However, comparatively large variations have been found in the thickness of OSB. If pallet leg 10 were used with OSB then the gap between flanges 22, 28 might be too large or too small to accommodate the OSB. For example, if the OSB is much thinner than the gap between flanges 22, 28 then the OSB will not be firmly gripped between the flanges; and, flange 28 could be subject to breakage due to its lack of lower support by the OSB. If the OSB is thicker than the gap between flanges 22, 28 then the OSB will not fit between the flanges at all. FIG. 7 depicts an alternate pallet leg 50 which overcomes these problems.

Figure 8:
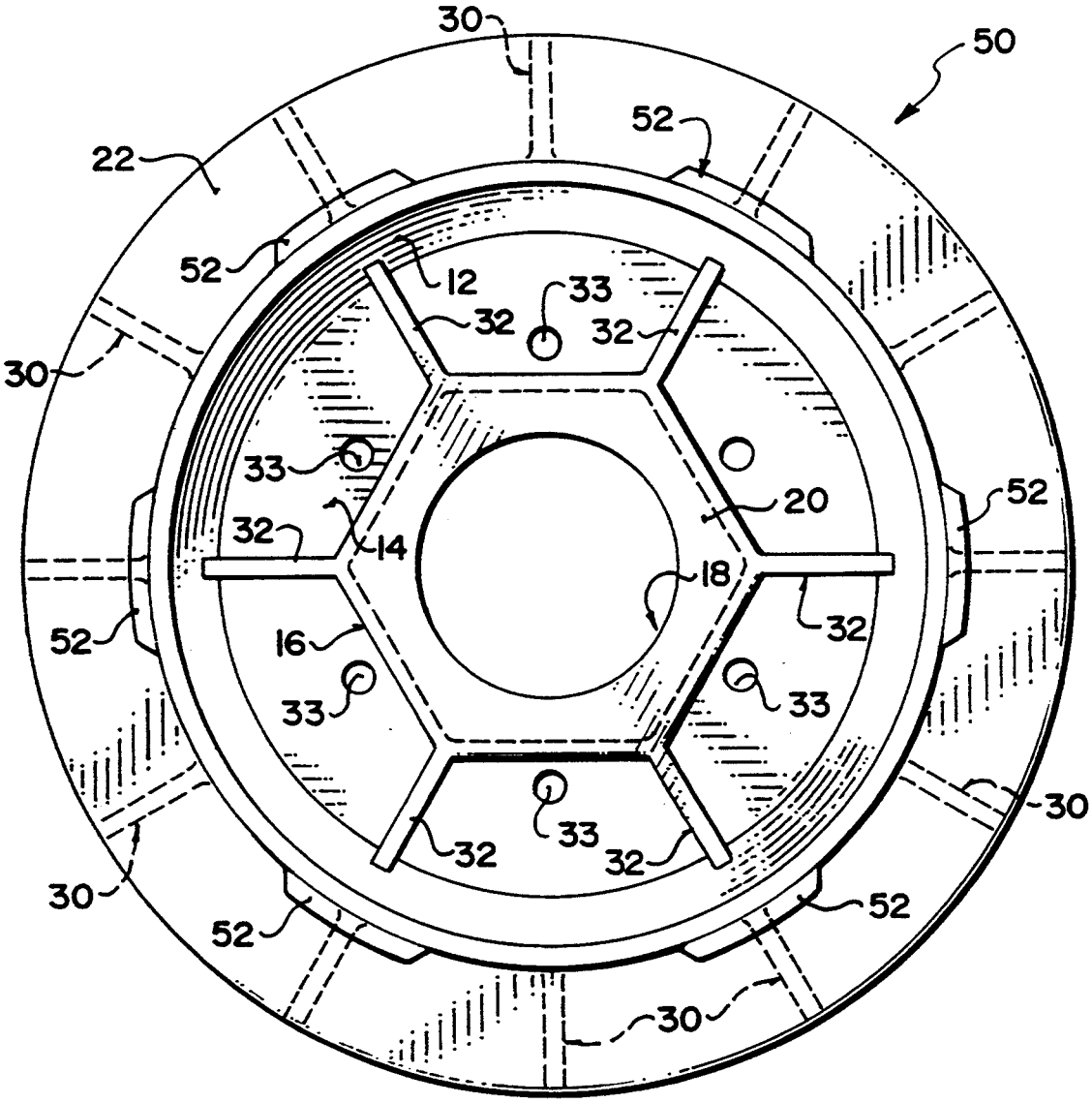
FIG. 8 is a top plan view of the pallet leg of FIG. 7, with the foot member removed.

Pallet leg 50 is identical to pallet leg 10, except that pallet leg 50 has no upper flanges 28. Instead, leg 50 has a plurality of blades 52 which are similar to flanges 28 in that blades 52 also protrude laterally outwardly from first member 12 and extend around respective radial segments of first member 12, as best seen in FIG. 8. However, blades 52 do not protrude outwardly from first member 12 as far as flanges 28; they are closer to flange 22 than flange 28; and, they engage the pallet sheet material differently than flanges 28.

Apertures (not shown) in the OSB are shaped so that blades 52 can pass upwardly into the apertures only when leg 50 is properly oriented relative to the apertures. Blades 52 do not pass completely through the apertures. The gap between blades 52 and circular flange 22 is made just large enough so that blades 52 remain adjacent the OSB material, irrespective of any OSB thickness variation, when leg 50 is inserted into an OSB aperture to butt flange 22 against the OSB material.

After leg 50 is inserted into the OSB aperture as aforesaid, the leg is rotated relative to the OSB, releasably attaching the leg to the OSB. More particularly, such rotation displaces blades 52 radially away from the OSB aperture portions through which they were inserted, causing the blades to bite into the OSB material. The OSB is thus sandwiched between flange 22 and blades 52 without leaving any upper protruding portion of pallet leg 50 which might interfere with a load placed upon the pallet. This not only prevents damage to delicate pallet loads, but also minimizes potential impact damage to pallet leg 50 by the load. Leg 50 can be removed from the OSB to disassemble the pallet by rotating leg 50 in the reverse direction to reorient blades 52 relative to the OSB aperture for withdrawal of blades 52 through the aperture.

Figure 9:
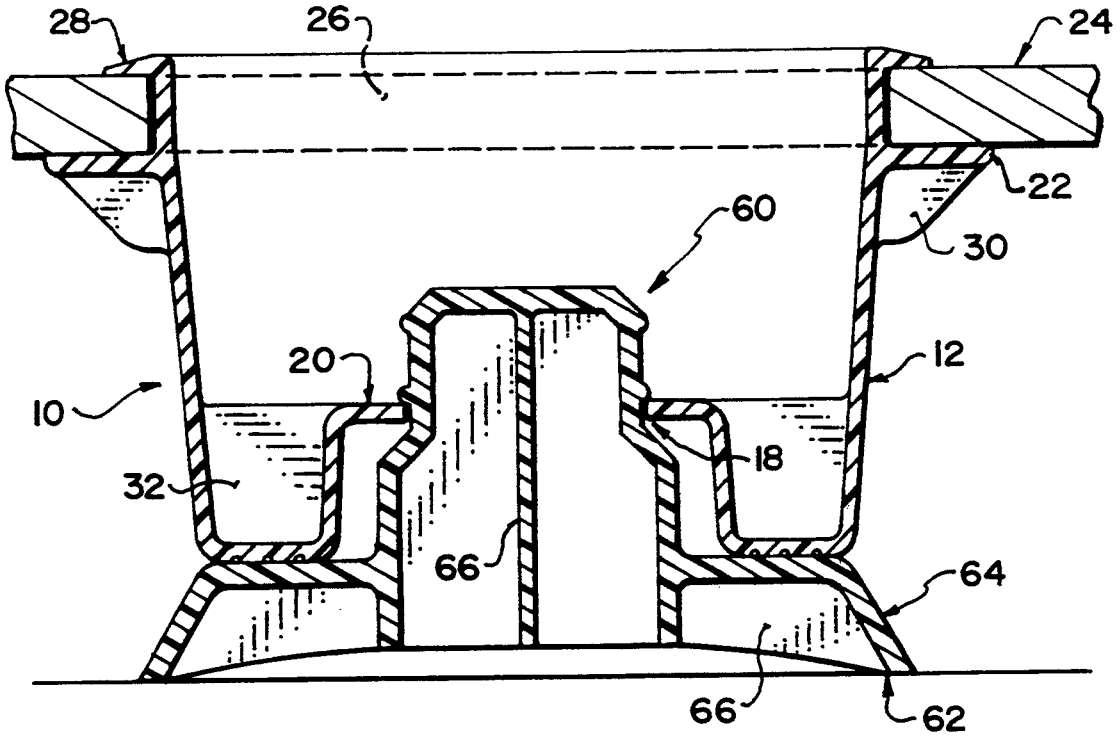
FIG. 9 is a cross-sectional side elevation view of a pallet having a pallet leg with an alternative foot member.
Figure 10:
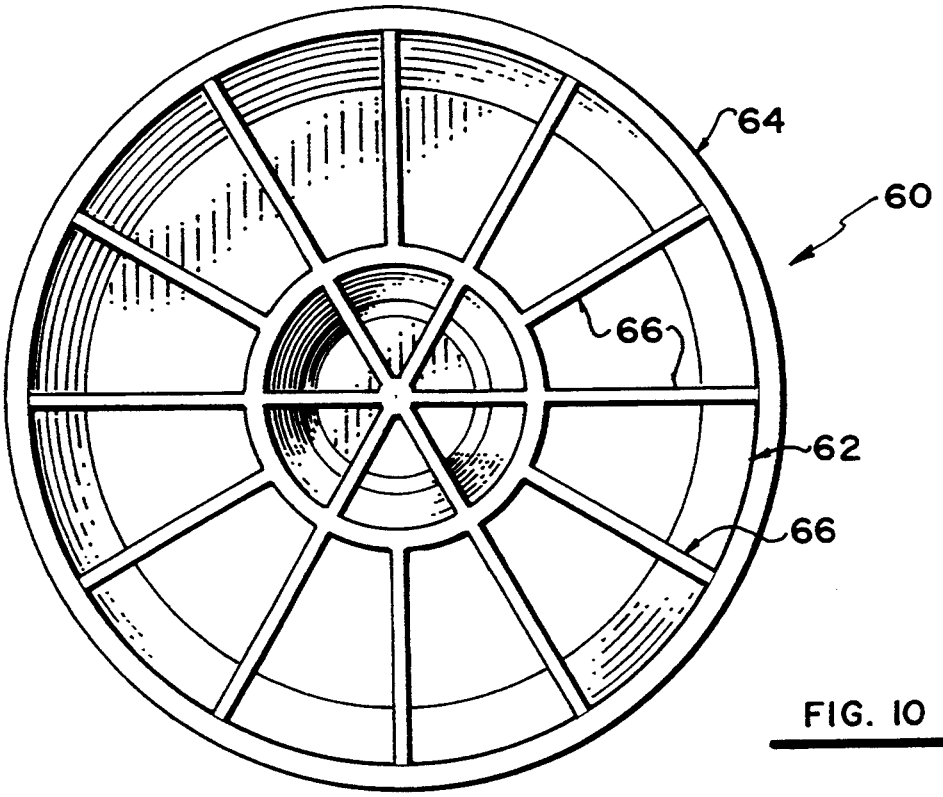
FIG. 10 is a bottom view of the alternate foot member depicted in FIG. 9.

In some situations it may be desirable to cushion the load supported by either of pallet legs 10 or 50. This may be accomplished by using the alternative foot member 60 depicted in FIGS. 9 and 10 instead of foot member 34. Foot member 60 has a radially extended base 62 which covers a much greater cross-sectional area than circular flange 38 of foot member 34. Foot member 60 is strengthened by sloping its outer circumferential edge 64 outwardly. Further strengthening is provided by fixing a plurality of ribs 66 between opposed internal sides of edge 64 at radial intervals. The bottoms of ribs 66 are concave. When a load is placed upon a pallet formed with pallet legs supported by foot members 60, the load is cushioned by outward flexing of outer circumferential edge 64. This allows the bottoms of ribs 66 to displace downwardly until they contact the surface on which the pallet is placed.

The portion of foot member 60 above base 62 is identical to the corresponding portion of foot member 34 and is coupled to either of pallet legs 10 or 50 in the same manner as foot member 34. Foot member 60 can also be used to support a second sheet of pallet material in a manner similar to foot member 34, with the second sheet being sandwiched between the upper surface of base 62 and the underside of the leg's base portion 14.

Foot member 60 is preferably made of a material which is capable of resuming its original shape after being deformed, such as urethane. Foot member 60 may also be provided in differing degrees of hardness for cushioning loads of different weight ranges.

Figure 11:
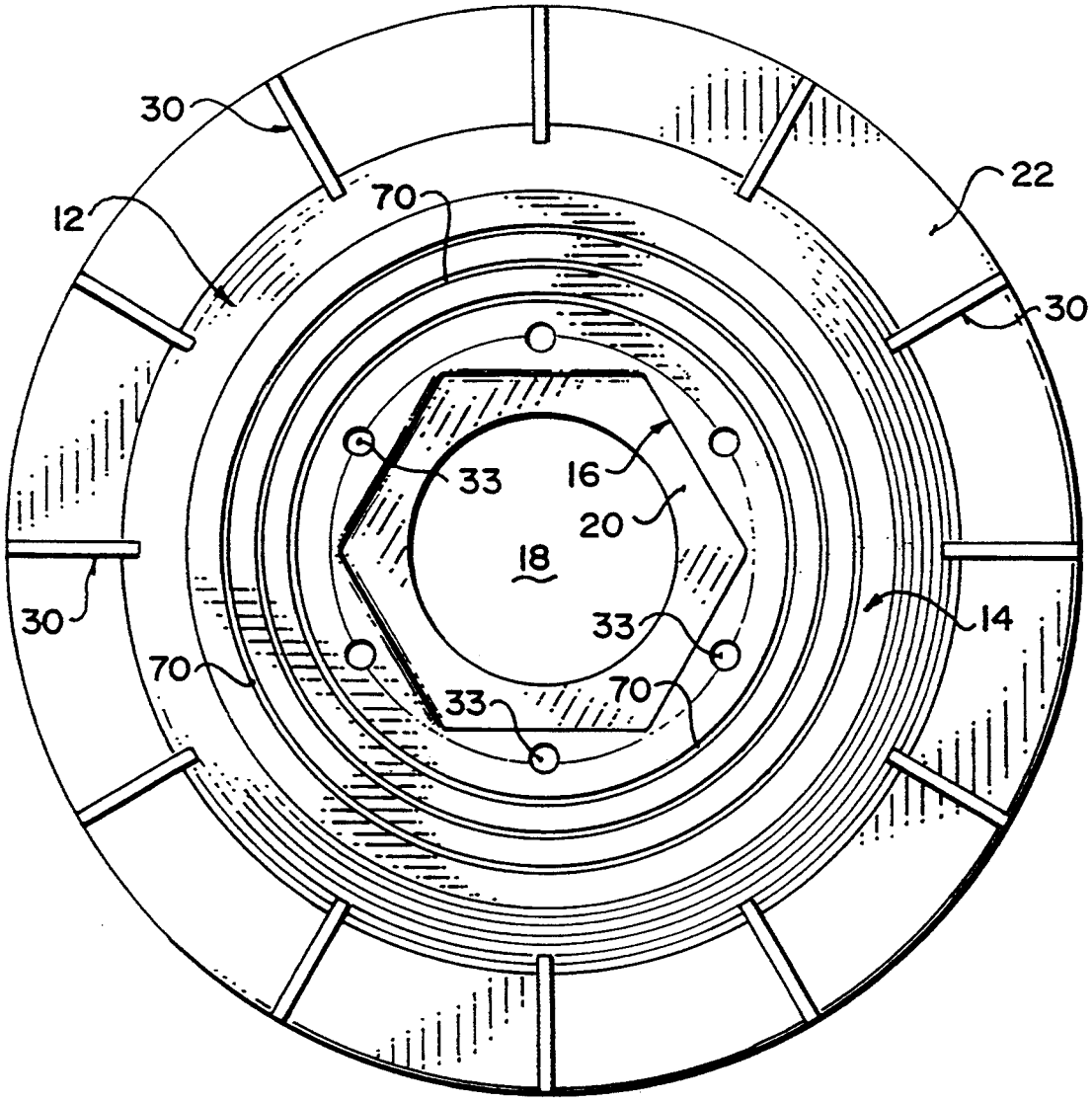
FIG. 11 is a bottom view of the base portion of the pallet leg of FIGS. 1 or 7, without any foot member.

FIG. 11 illustrates the provision of a plurality of anti-skid rings 70 on the bottom of base portion 14 of either of pallet legs 10 or 50. If legs 10 or 50 are used without one or the other of feet member 34, 60 then the bottom of base portion 14 will contact the surface on which the loaded pallet is placed. Rings 70 resist forces which might otherwise cause the pallet legs to skid laterally across the surface.

Figure 12:
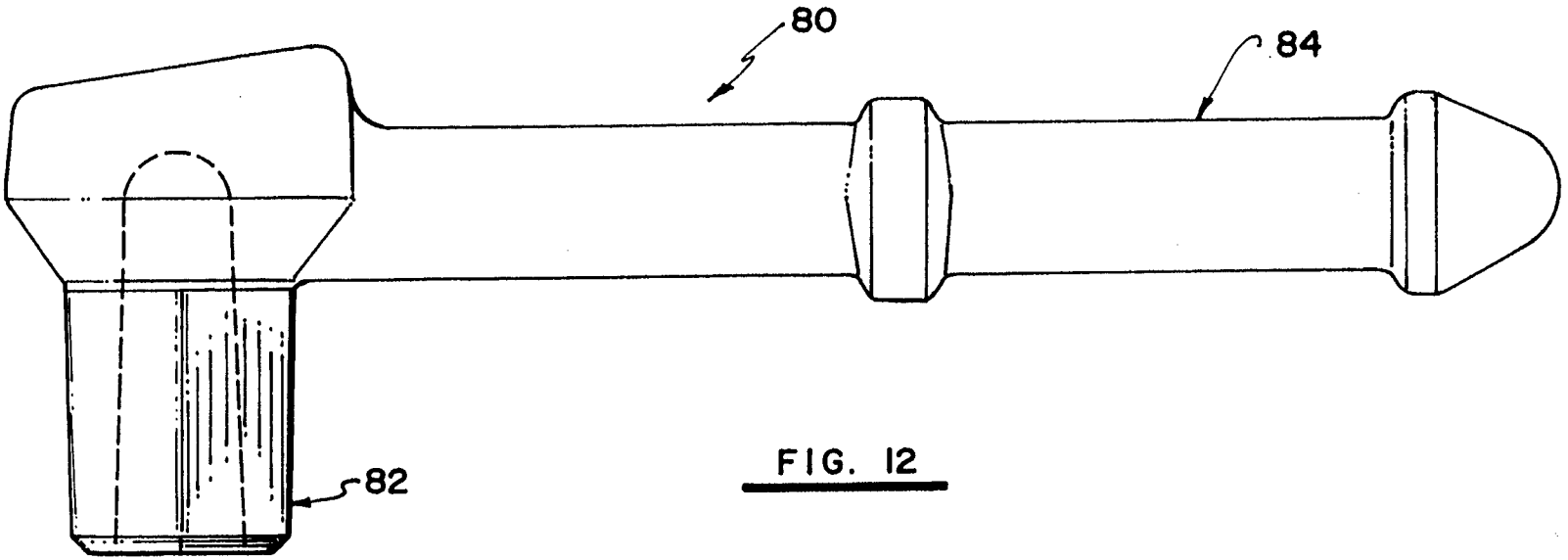
FIG. 12 is a side elevation view of a tool for assisting in coupling or decoupling the pallet leg of FIGS. 1 or 7 to a sheet of pallet material.
Figure 13:
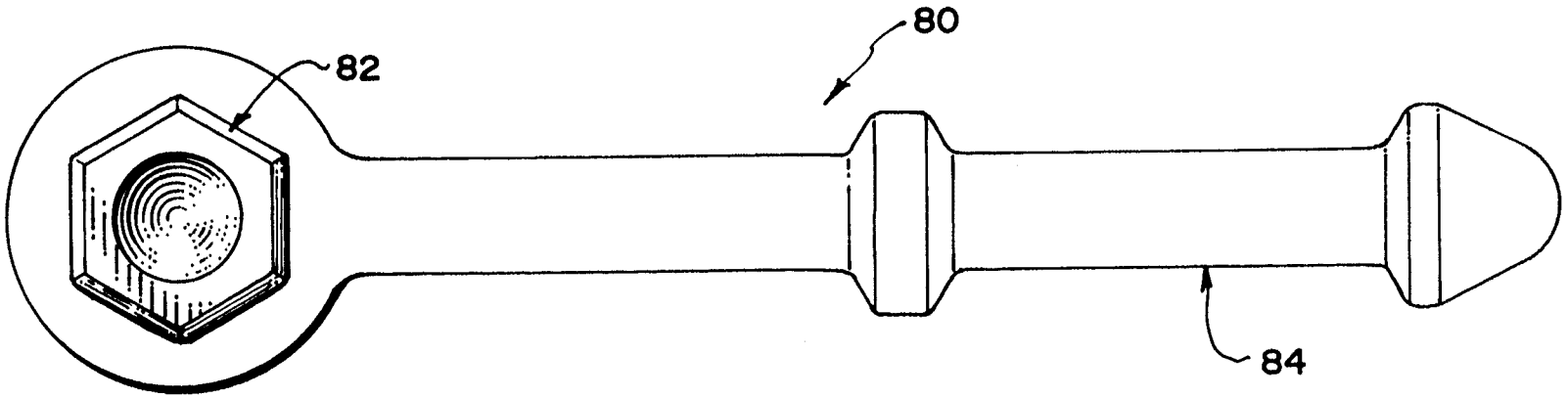
FIG. 13 is a bottom view of the tool of FIG. 12.

Because it can be difficult for a single man to impart the rotational force required to releasably attach either of pallet legs 10 or 50 to a sheet of pallet material or remove the attached leg therefrom, second hollow columnar member 16 is preferably given a hexagonal shape as best seen in FIGS. 2, 8 and 11. A tool 80 (FIGS. 12 and 13) having a hexagonal head 82 is provided. Hexagonal head 82 is sized to fit within the hexagonally shaped portion of the pallet leg. The tool's handle 84 provides sufficient leverage to enable a single man to rotate the pallet leg in order to releasably attach it to the pallet sheet material or remove it therefrom.

The hexagonal shape of second hollow columnar member 16 (which is identical in either of legs 10 or 50) additionally provides lateral support for circular portion 43 (which is also identical in either of foot members 34 or 60). More particularly, columnar member 16 and circular portion 43 are sized so that extended portions of the outer circumferential face of portion 43 contact each of the six faces of member 16 as the foot member is advanced upwardly within the columnar member.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A pallet support leg, comprising:

(a) a first short, hollow columnar member having a lower base portion indented to form a second hollow columnar member protruding upwardly within said first columnar member by no more than about one-third the height of said first columnar member;

(b) a circular flange protruding outwardly from and encircling an upper portion of said first columnar member;

(c) at least one semi-circular flange protruding outwardly from said first columnar member, above said circular flange and extending around a radial segment of said first columnar member; and, (d) a first plurality of support ribs fixed between an underside of said circular flange and said first columnar member, said ribs disposed radially around said first columnar member;

wherein said semi-circular flanges are blades displaced above said circular flange by an amount less than the thickness of a sheet of pallet material to enable penetration of said blades within said sheet of pallet material upon application of a rotational force to said pallet support leg after engagement thereof with said sheet of pallet material.

2. A pallet support leg as defined in claim 1, wherein said second columnar member is shaped to receive a tool for rotating said support leg relative to a sheet of pallet material.

3. A pallet support leg as defined in claim 1, further comprising at least one anti-skid ring on said lower base portion of said first columnar member.

4. A pallet support leg as defined in claim 1, further comprising a second plurality of support ribs fixed between an inner surface of said first columnar member and an outer surface of said second columnar member, said second plurality of ribs disposed radially around said columnar members.

5. A pallet support leg as defined in claim 4, wherein said second columnar member has an apertured upper end.

6. A pallet support leg as defined in claim 5, further comprising a foot member releasably engageable within said apertured upper end of said second columnar member.

7. A pallet support leg as defined in claim 6, wherein said second columnar member makes lateral contact over an extended side portion of said foot member when said foot member is releasably engaged within said second columnar member.

8. A pallet support leg as defined in claim 7, wherein said second columnar member is hexagonally shaped and said side portion of said foot member is circular.

9. A pallet support leg as defined in claim 8, wherein said foot member further comprises:

(a) a third hollow columnar member;

(b) a circular flange protruding outwardly from and encircling a lower portion of said third columnar member; and, (c) releasable engaging means on an upper portion of said third columnar member for releasably engaging said third columnar member with said second columnar member.

10. A pallet support leg as defined in claim 9, wherein said circular flange is radially extended to cover about the same cross-sectional area covered by said lower base portion of said first columnar member, said foot member further comprising:

(a) a outwardly sloped outer circumferential edge; and, (b) a plurality of concave ribs fixed at radial intervals between opposed internal sides of said edge.

11. A pallet support leg as defined in claim 9, wherein said releasable engaging means comprises at least one snap ring encircling said upper portion of said third columnar member, said snap ring(s) having an outer diameter slightly greater than said aperture diameter, and said third columnar member having an outer diameter slightly less than said aperture diameter.

12. A pallet support leg as defined in claim 11, further comprising a plurality of slots extending through said upper portion of said third columnar member, transversely to said snap ring(s).

* * * * *